US007249480B2

(12) United States Patent
Ghiran et al.

(10) Patent No.: US 7,249,480 B2
(45) Date of Patent: Jul. 31, 2007

(54) IN-DIE HYDROPIERCING DEVICE FOR PIERCING HOLES IN HYDROFORMED PARTS

(75) Inventors: Mircea M. Ghiran, Lake Orion, MI (US); Gerry A. Harmon, Clawson, MI (US)

(73) Assignee: General Motors Corporation, Detroit, MI (US)

( * ) Notice: Subject to any disclaimer, the term of this patent is extended or adjusted under 35 U.S.C. 154(b) by 508 days.

(21) Appl. No.: 10/948,974

(22) Filed: Sep. 24, 2004

(65) Prior Publication Data

US 2006/0065030 A1 Mar. 30, 2006

(51) Int. Cl.
*B21D 28/18* (2006.01)
*B21D 28/28* (2006.01)

(52) U.S. Cl. ..... 72/55; 72/370.27; 72/427; 29/421.1; 83/53

(58) Field of Classification Search ..... 72/55, 72/56, 370.27, 427; 29/421.1; 83/53, 54
See application file for complete search history.

(56) References Cited

U.S. PATENT DOCUMENTS 5,816,089 A * 10/1998 Marando ..... 72/55
6,006,566 A * 12/1999 Huelsberg et al. ..... 72/427
6,401,507 B1 * 6/2002 Krcek et al. ..... 72/56
6,658,908 B1 12/2003 Ghiran et al. ..... 72/55
6,672,120 B1 * 1/2004 Ghiran et al. ..... 83/53
6,681,611 B2 * 1/2004 Haag et al. ..... 72/370.27
7,104,099 B1 * 9/2006 Ghiran et al. ..... 29/421.1

* cited by examiner

*Primary Examiner*—David Jones

(57) ABSTRACT

An in-die hydropiercing device comprises a punch with an annular shearing blade which is operated by a hydraulic cylinder and is received in a ring-shaped die button mounted in one of the dies that form a die cavity for the hydroforming of a part, a center support member that is received in the center of the punch and supports the wall of the part inward of the shearing blade during the hydroforming of the part and also during the piercing of the part with the shearing blade, a slug collector, and a slug retainer that is mounted on the center support member and provides for retention of a slug produced from the piercing operation against the center support member and later releases the slug onto the slug collector for disposal following the opening of the dies and insertion of the slug collector between the open dies and then retraction of the slug collector with the slug for slug disposal.

11 Claims, 15 Drawing Sheets

IN-DIE HYDROPIERCING DEVICE FOR PIERCING HOLES IN HYDROFORMED PARTS

TECHNICAL FIELD

This invention relates to the piercing of holes in hydroformed parts while the parts remain in the hydroforming dies and more particularly to the devices used for such piercing.

BACKGROUND OF THE INVENTION

In the formation of one or more required holes in a hydroformed metal part, it is well known that the holes can be formed with a punch in a piercing operation on the part. While the part remains in the hydroforming dies following its hydroforming to the required shape and with the support of the internal hydroforming pressure. For example, there is shown in FIG. 1 of the accompanying drawings a prior art device that performs such a piercing operation. With such operation and the device for accomplishing it also being referred to herein as "hydropiercing" and "in-die hydropiercing device", respectively.

In the exemplary prior art device in FIG. 1, the piercing is performed on a hydroformed part A while the part remains in the hydroforming dies B and C in which it was formed and the hydroforming pressure is maintained therein. The piercing is typically performed by a flat-faced punch D that is received in a ring-shaped die button E that is mounted in the die cavity surface F of one of the hydroforming dies in a position aligned with where the hole is required in the part. In this case the hole is required in the upper side of the part A and therefore the die button E is located in the die cavity surface of the upper die C. The punch D and a central bore in the die button E in which the punch is received have a cylindrical shape corresponding to that of the hole required in the part and which is typically a right-circular, cylindrical shape to produce a circular hole but can also be of some other cylindrical configuration or shape such as oval, square and rectangular.

The punch D is operated by a hydraulic cylinder G and is initially positioned thereby so that the face H of the punch together with the face I of the die button form a continuation of the surrounding die cavity surface for the hydroforming of the part A from a piece of tubular metal stock. Wherein a suitable liquid is supplied to the interior of the piece at a sufficiently high pressure such as about 10,000 psi to form the part outwardly against the die cavity surface. The punch D following formation of the part is then extended by the hydraulic cylinder G as shown and with the support of the hydroforming pressure in the part acting outwardly on the wall of the part about the die button face I pierces a required hole J in the part. Whereby a slug K is separated from the wall of the part in the formation of the hole, settles to the bottom of the part and must be removed later. Moreover, as the punch D pierces the part, the hydroforming fluid with such a punch is prone to leak out of the hole past the punch causing a significant drop in internal pressure. Which can result in a collapse of the wall of the part adjacent the hole such as to the configuration shown in phantom-lines. Moreover, such leakage makes it difficult, if not impossible, to punch more than one hole in the part using similar punch devices whereas more holes may be required in the part and could be punched simultaneously if none of the punch devices caused significant leakage during their piercing operation.

The quest for efficient sealing during piercing and efficient slug removal are but two of the goals faced in expanding the use of in-die hydropiercing. As larger holes are being required which has necessitated larger diameter, more costly, hydraulic cylinders in order to deliver the larger piercing forces required. And not only are larger, more costly, hydraulic cylinders required for the larger holes, they typically must have a longer stroke for both relatively small and large holes where the punch is designed to also form an inward extrusion in the wall of the part surrounding the hole that will effectively seal against the punch to prevent leakage. Such as disclosed in U.S. Pat. No. 6,658,908 that is assigned to the assignee of this invention. Or the hydraulic cylinder may require an unusually large stroke simply to push the larger slugs at least to the side and out of the way of the hole. Moreover, such larger hydraulic cylinders are not only more costly; they require significantly larger packaging space in the hydroforming apparatus and significantly larger hydraulic fluid flow in order to operate.

SUMMARY OF THE INVENTION

In the present invention and with the above goals in mind, there is provided an in-die hydropiercing device for piercing hydroformed parts comprising a die button that is adapted to be mounted in one of the two hydroforming dies in a location opposite where a hole is required in the part being hydroformed and so that a face of the die button is flush with the surrounding die cavity surface. A punch operated by a hydraulic cylinder is received in a central bore in the die button and has an annular blade with a sharp shearing edge that is undersize with respect to that of the required hole. A center support member is closely received in the center of the punch blade and is fixed to the same die as the die button and provides the punch with support for the wall of the part inward of the punch blade for both the hydroforming operation and during the piercing operation. And a slug retainer is centrally mounted in the face of the center support member for retaining a slug produced from the piercing operation against the center support member and later dispensing therewith when the dies are opened.

In one exemplary embodiment of the invention, the center support member has a face that is located flush with the surrounding die button face and die cavity surface and the hydraulic cylinder initially positions and holds the punch in a non-piercing position wherein the shearing edge of the punch blade is located flush with the die button face and the center support member face so as to not to cause piercing of the wall of the part during the hydroforming operation. Following the hydroforming of the part with the aid of the center support member in the punch, the hydraulic cylinder then extends or plunges the punch such that the shearing edge of the punch blade extends past the die button face and the center support member face to pierce an undersize hole in the hydroformed part with the support of the hydroforming pressure in the part. And as a result, produces a slug that is pierced (sheared) from the wall and is retained against the center support member by the slug retainer. Where after and with continued punch movement, trailing sides of the annular punch blade enter the pierced hole and form an inwardly extending annular collar in the wall of the part that tightly seals against the outer side of the punch blade to prevent leakage at this site and also an inwardly extending annular collar on the slug that tightly seals against the inner side of the punch blade to prevent leakage at this site. With such piercing and collar formation in the part by the punch, a hole of the required size and shape is formed with the completion of the punch stroke by the outer side of the punch blade and is thus formed substantially leakage free and with a minimized stroke. The dies are then opened to remove both the part and the slug and wherein as to the latter, a slug collector is inserted between the open dies and underneath the slug collector and the slug retainer then releases the slug to the slug collector that is then retracted with the slug for disposal. And the required hole is thus produced with significantly less hydraulic power requirements because of the use of a shearing blade as compared for example with the use of a flat punch face.

As disclosed in another exemplary embodiment of the invention, the power requirements and the stroke required of the hydraulic cylinder stroke are further minimized by the addition of a pre-piercing operation that weakens an annular portion of the wall of the part where the punch blade eventually enters during the piercing operation. In this embodiment, the center support member is fixed in the one die in a position so that its face is spaced a predetermined distance backward from the die button face and the surrounding die cavity surface. And the punch is initially positioned by the hydraulic cylinder so that the punch blade shearing edge is also spaced a like distance backward from the die button face. As a result, the annular wall section of the part between the center support member face and the die button face and opposite the punch blade is stretched outwardly and forced over a sharp outer edge of the central die button bore during the hydroforming of the part. Which has the effect of significantly weakening this wall area close to the point of shearing away or breaking prior to penetration by the annular punch blade and its operation which also effects sealing with respect to the part and the slug in a manner like the afore-mentioned embodiment but with less inward extrusion of the hole edge and slug edge required for the sealing effect. And as a result, this embodiment significantly reduces both the power and stroke required of the hydraulic cylinder as compared with no such pre-piercing operation.

These and other aspects of the present invention will become more apparent from the accompanying drawings and the following detailed description.

DESCRIPTION OF EXEMPLARY EMBODIMENTS

Figure 1:
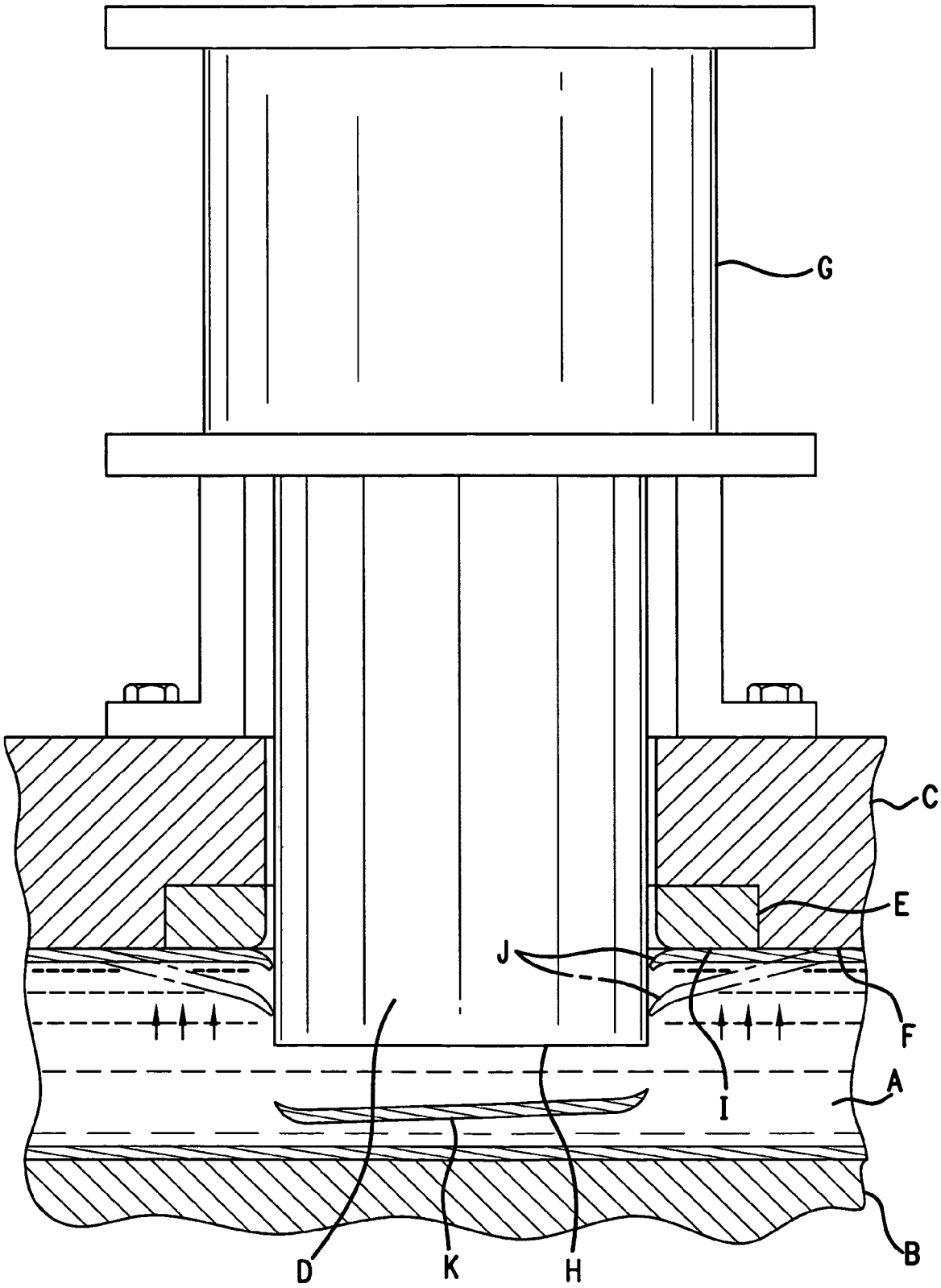
FIG. 1 PRIOR ART
FIG. 1 is a view mainly in section of a prior art, in-die hydropiercing device.
Figure 2:
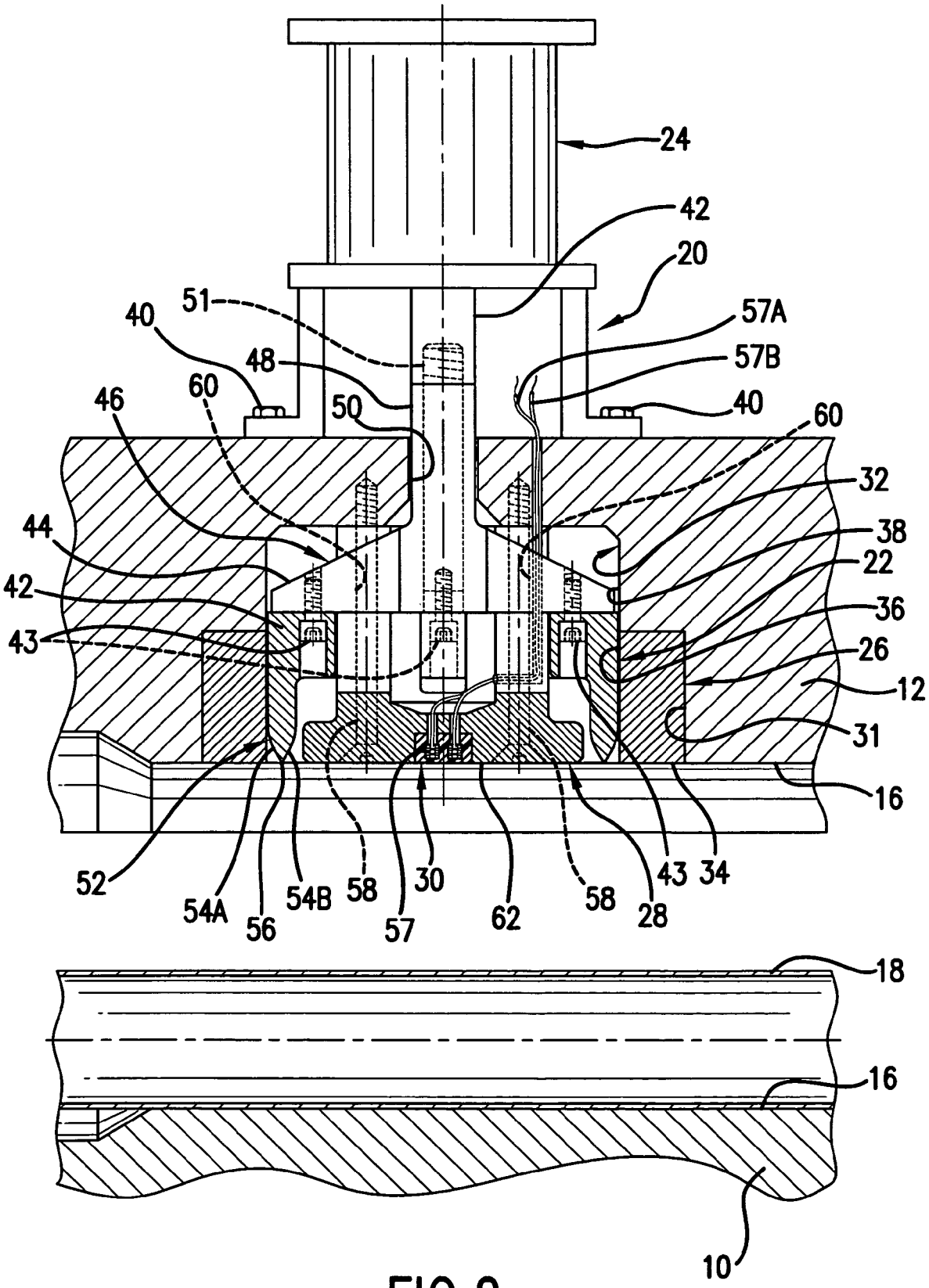
FIG. 2 is a view mainly in section of an in-die hydropiercing device according to the present invention wherein the punch in the device which has a centrally located support member is received in a die button and is shown positioned for the start of the hydroforming process prior to the closure of the hydroforming dies on a piece of tubular stock.
Figure 3:
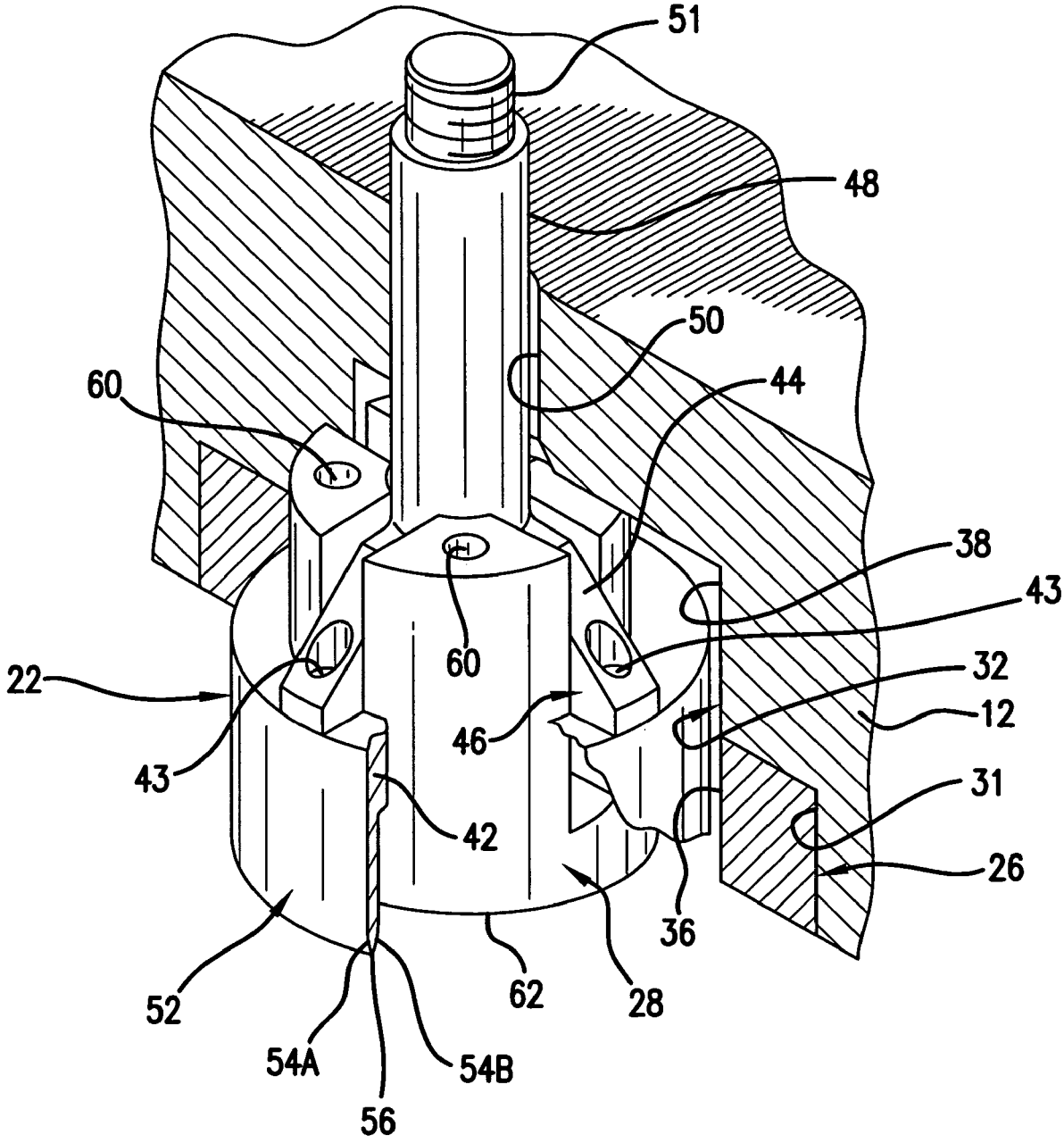
FIG. 3 is a three-dimensional view of the punch end of the hydropiercing device in FIG. 2.
Figure 4:
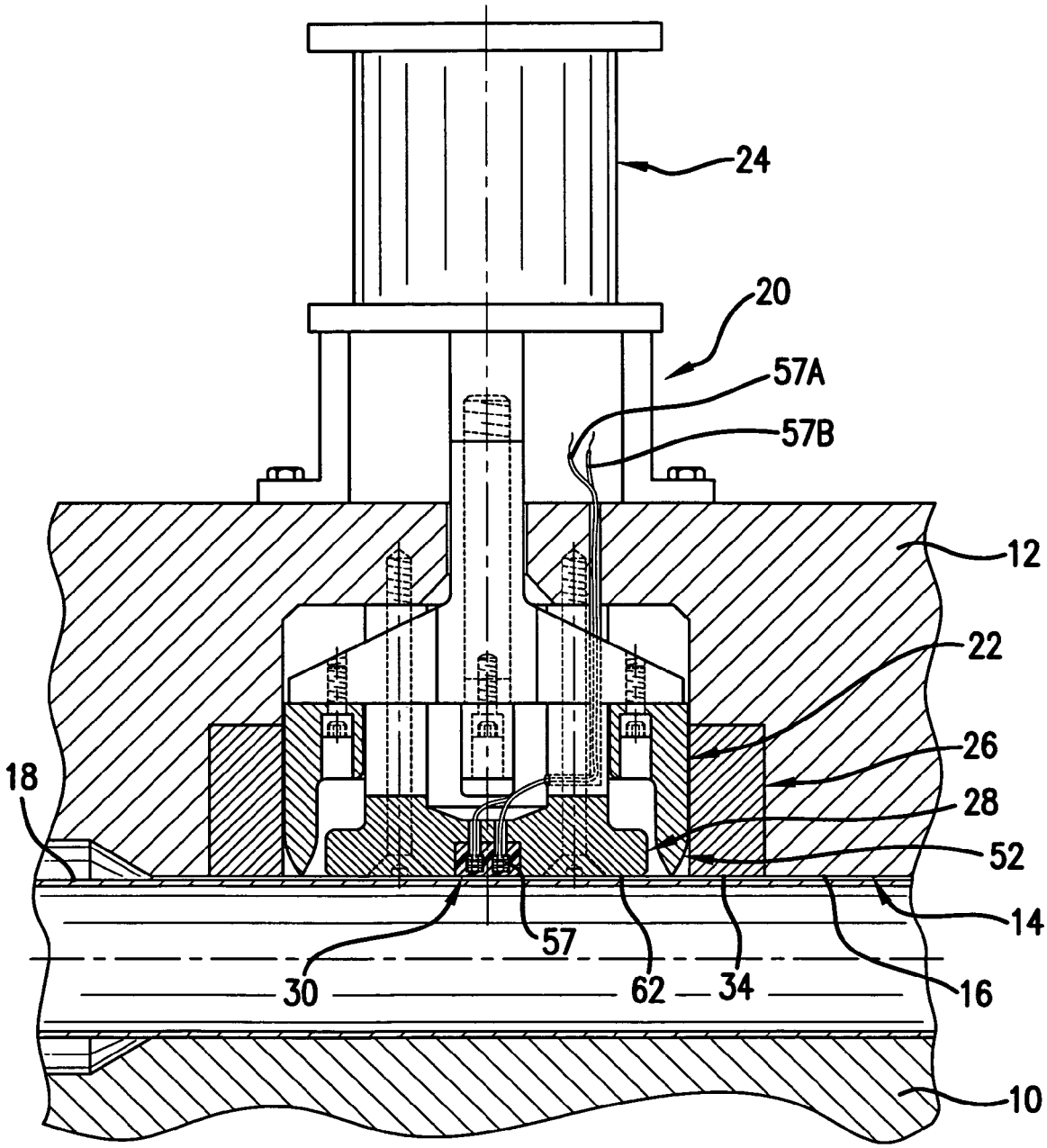
FIG. 4 is a view like FIG. 2 but showing the hydroforming dies closed on the piece of tubular stock.
Figure 5:
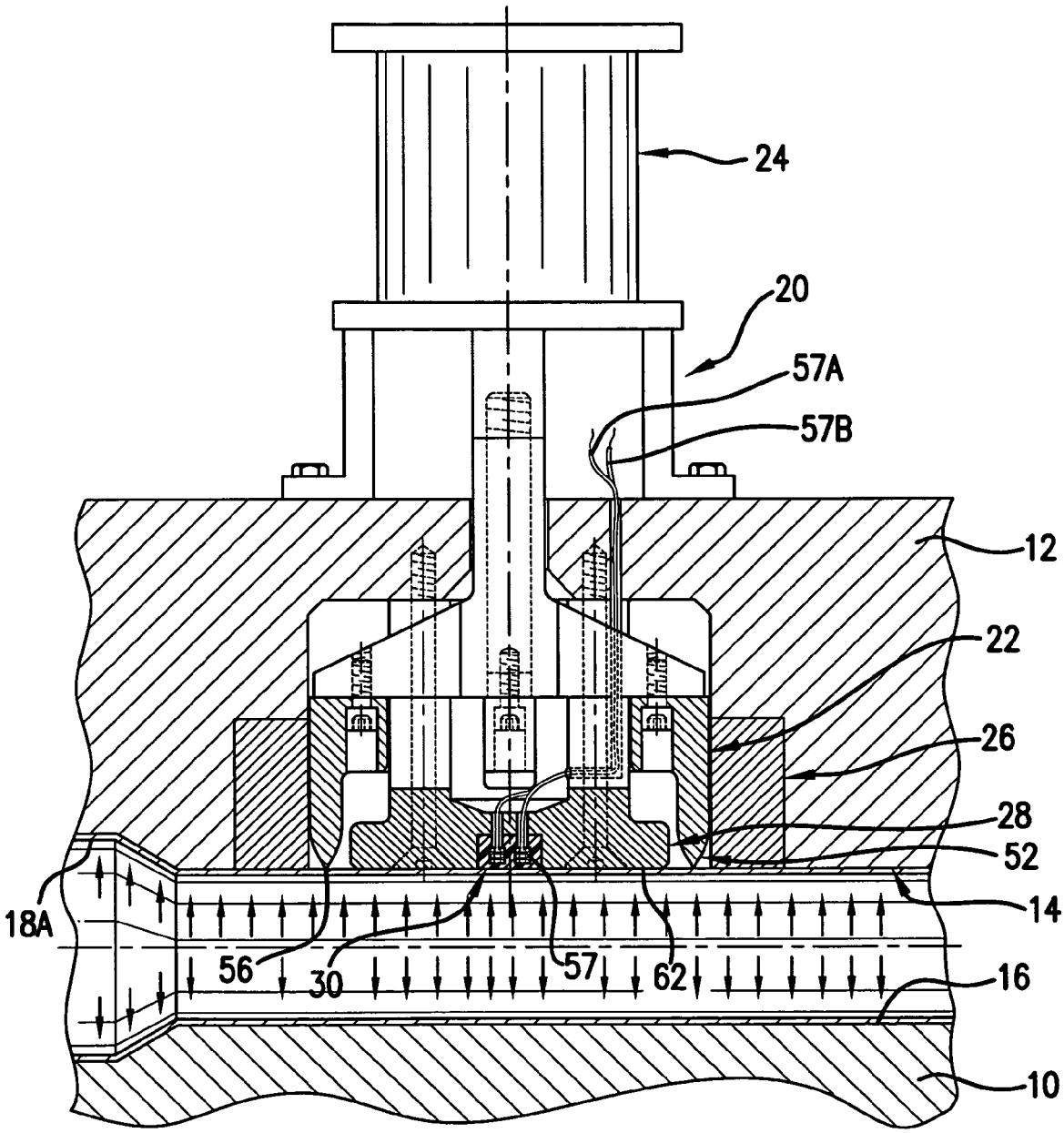
FIG. 5 is a view like FIG. 4 but showing hydroforming pressure forming the part.

Referring to FIGS. 2-9, there is shown an intermediate portion of a conventional hydroforming apparatus comprising a lower die 10 and upper die 12 that when closed co-operatively defined a die cavity 14 (see FIGS. 4-7) having a surface 16 conforming to the required shape of the finished part. In the hydroforming process, a piece 18 of tubular metal stock is located in the lower die 10 as shown in FIG. 2 and the upper die 12 is then lowered to form the die cavity 14 about the piece 18 as shown in FIG. 4. A suitable hydroforming fluid, typically in the form of a water based liquid solution, is then delivered to the interior of the captured piece 18 through one end thereof while the other end is closed. With the hydroforming fluid thus delivered being raised to a pressure sufficient to forcibly expand the wall of the piece outward to conform to the die cavity surface 16 to thereby form a hydroformed part 18A as shown in FIG. 5. Following the formation of a required hole in the part as described later, the remaining hydroforming fluid in the part is then exhausted by opening the closed end of the part. Further details of the type of hydroforming apparatus for which the present invention is suited are for example disclosed in U.S. Pat. No. 5,321,964 assigned to the assignee of the present invention and which is hereby incorporated by reference.

The present invention resides in an in-die hydropiercing device 20 for piercing a required hole in a hydroformed part such as the part 18A which in this exemplary case is a motor vehicle component produced in high volumes and requiring precision in the hole required in the part. And wherein in this example, the hole required in the part is a precise circular hole and is located in the upper side of the part that is located in the upper die 12. The hydropiercing device 20 generally comprises a punch 22 that is operated by a hydraulic cylinder 24 and is received in a cylindrical ring-shaped die button 26, a center support member 28 that is received in the punch, a slug retainer 30 that is mounted on the center support member, and a slug collector as later referenced with a reference number.

In adapting the hydropiercing device 20 to form the required hole, the die button 26 is mounted in a counter-bore 31 of a two-step bore 32 in the upper-die 12 that is centrally aligned with the required hole in the part. See FIG. 2. With the die button 26 located by the counter-bore 31 so that a flat outer face 34 thereof is flush with the surrounding die cavity surface 16 and a central bore 36 therein forms a continuation of a smaller diameter counter-bore 38 of the stepped die bore 32 extending to the die button face 34. The hydraulic cylinder 24 that operates the punch 22 is rigidly mounted on the upper side of the upper die 12 with bolts 40 and has a cylinder rod 42 that is in axial alignment with the die bore 32 and the center bore 36 in the die button 26. And wherein it will be understood that the hydraulic cylinder 24 is operated and controlled in the manner described later with a hydraulic system including a programmable controller of a suitable conventional type.

The punch 22 has an annular cylindrical main body 42 that is closely received at its cylindrical outer periphery in the die button bore 36 and is fastened by bolts 43 to the head 44 of a tool adapter 46 that connects the punch with the hydraulic cylinder. The tool adapter head 44 has an outer diameter that is slightly less than that of the main body 42 of the punch so as to be freely received in the counter-bore 38 that is located inward of the counter-bore 31 and the die button 26. The tool adapter 46 further has a cylindrical extension or shaft portion 48 extending from its head 44 that is closely received in a relatively small diameter portion 50 of the stepped die bore 32 and is detachably connected by a threaded connection 51 or other suitable means to the end of the cylinder rod 42. Whereby the punch 22 is adapted to be connected to the hydraulic cylinder 24 by insertion of the punch from the cavity side of the upper die 12.

Referring to FIGS. 2 and 3, piercing by the punch 22 is provided by an annular blade 52 that extends from the main body 42 of the punch toward the die cavity and has convex sides 54A and 54B that terminate in a sharp annular shearing edge 56. Wherein the shearing edge 56 has a predetermined diameter less than that of the required hole in the part in order to provide for an inwardly directed extruding operation during the formation of the hole. And wherein the outer diameter of the main body 42 of the punch is substantially larger than that of the shearing edge 56 and is equal to the diameter of the required hole so as to provide a precise hole sizing operation as it enters the hole behind the blade 52.

The center support member 28 is received with radial clearance in the punch blade 52, is fixed to the upper die 12, and provides for support of the wall of the part inward of the punch blade during the hydroforming and piercing operations and also provides support for the slug retainer 30. The slug retainer 30 may be an electromagnet as shown having a coil 57 with insulated lead wires 57A and 57B leading out through a passageway in the center support member 28, the head 44 of the tool adapter 46 and the upper die 12. And wherein it will be understood that the lead wires 57A and 57B provide for connection of the electromagnet with an electrical circuit of a suitable conventional type (not shown) that includes a programmable controller programmed to operate the electromagnet in the manner described later.

The slug retainer may also be a vacuum operated device of a suitable conventional type such as a suction cup and in particular when the metal part being hydroformed is not magnetic. Wherein the suction cup has a perforated metal face that is located in the center support member 28 so as to be directly exposed to the outer side of the part where the hole is required. And in the case of a vacuum operated slug retainer device, it will be understood that the vacuum operated device is connected by a vacuum line with a pneumatic circuit of a suitable conventional type that like the electromagnetic slug retainer has a programmable controller that is programmed to operate the vacuum operated slug retainer for slug retention and disposal in the same manner as the electromagnet slug retainer described later.

The center support member 28 is fixed to the upper die 12 by bolts 58 that extend freely through the center of the punch 22 and holes 60 in the tool adapter head 44. See FIGS. 2 and 3. And the center support member 28 has a flat circular outer face 62 in which the slug retainer 30 is centrally mounted in a cylindrical recess therein and together therewith forms a continuation of the die cavity surface 16 within the punch 22 and more specifically within the blade 52 of the punch. And wherein both the outer face 34 of the die button 26 and the outer face 62 of the center support member 28 are at right angles to the centerline of the punch Describing now the operation of the in-die hydropiercing device 20, the hydraulic cylinder 24 is operated to position the punch 22 in the position shown in FIG. 2 prior to the processing of the piece of stock 18. Wherein the shearing edge 56 of the punch blade 52 is located flush with the surrounding die button face 34 and the internally located center support member face 62. Then on closure of the upper die 12 on the piece of tubular stock, the hydropiercing device 20 forms a portion of the die cavity 14 with the die button surface 34 and the center support surface 62 as shown in FIG. 4. Whereby the center support surface 62 then plays a primary role in supporting the wall of the part inward of the die button face 34 and the punch blade 52 during the hydroforming operation in the formation of the part 18A as shown in FIG. 5. And wherein the shearing edge 56 of the punch that is located between the center support member surface 62 and the die button face 34 plays much less but still a significant role in supporting the wall of the part between the center support member and the die button during the hydroforming operation.

Figure 6:
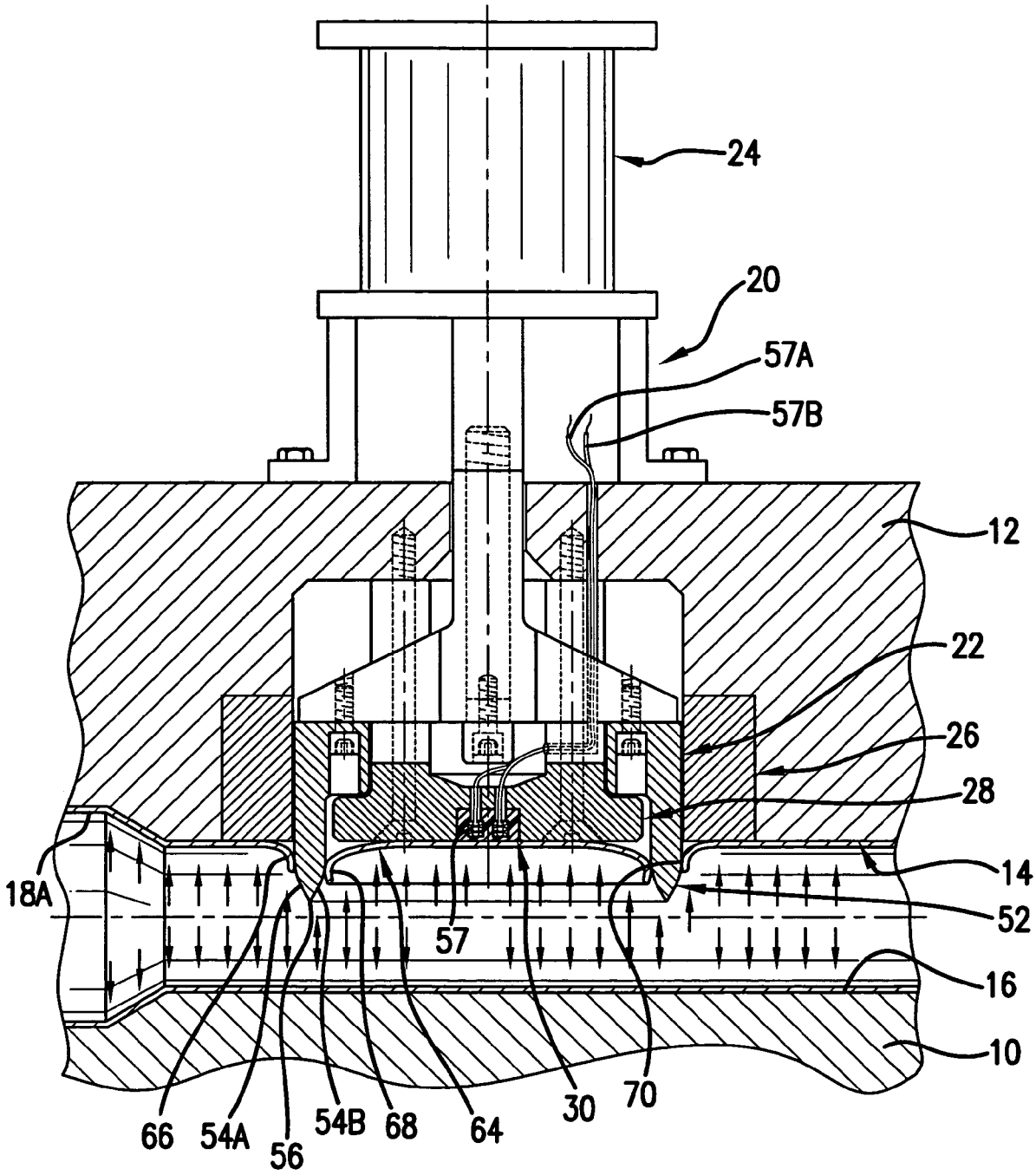
FIG. 6 is view like FIG. 5 but showing the punch piercing the part to form a hole and a resultant slug that is retained against the center support member.

Following the hydroforming of the part 18A and while the forming pressure is maintained in the part as shown in FIG. 6, the hydraulic cylinder 24 is then operated to extend the punch 22 and force the punch blade shearing edge 56 to shear or pierce the wall of the part to form an initial and under-size hole and resultantly a slug 64 that is retained against the face of center support member by the forming pressure as well as the slug retainer 30. The punch 22 is continued to be advanced or plunged by the hydraulic cylinder 24 following the piercing of the hole and the convex sides 54A and 54B of the punch blade which trail the shearing edge 56 then enter the pierce hole and form an inwardly extending annular collar 66 in the surrounding wall of the part and an inwardly extending annular collar 68 on the periphery of the slug 64. Wherein the collars 66 and 68 thus formed tightly seal against the respective sides of the punch blade to prevent hydroforming fluid leakage from the part as the punch blade fully proceeds to form the undersized hole to a hole 70 of the required size with the outer cylindrical surface of the main body 42 of the punch that trails the outer convex side 54A of the punch blade. With the punch stroke and thus that of the hydraulic cylinder just sufficient to perform the above operations and thus being performed with significantly less hydraulic power and hydraulic flow requirements because of the use of a shearing blade as compared for example with the use of a flat punch face.

Figure 7:
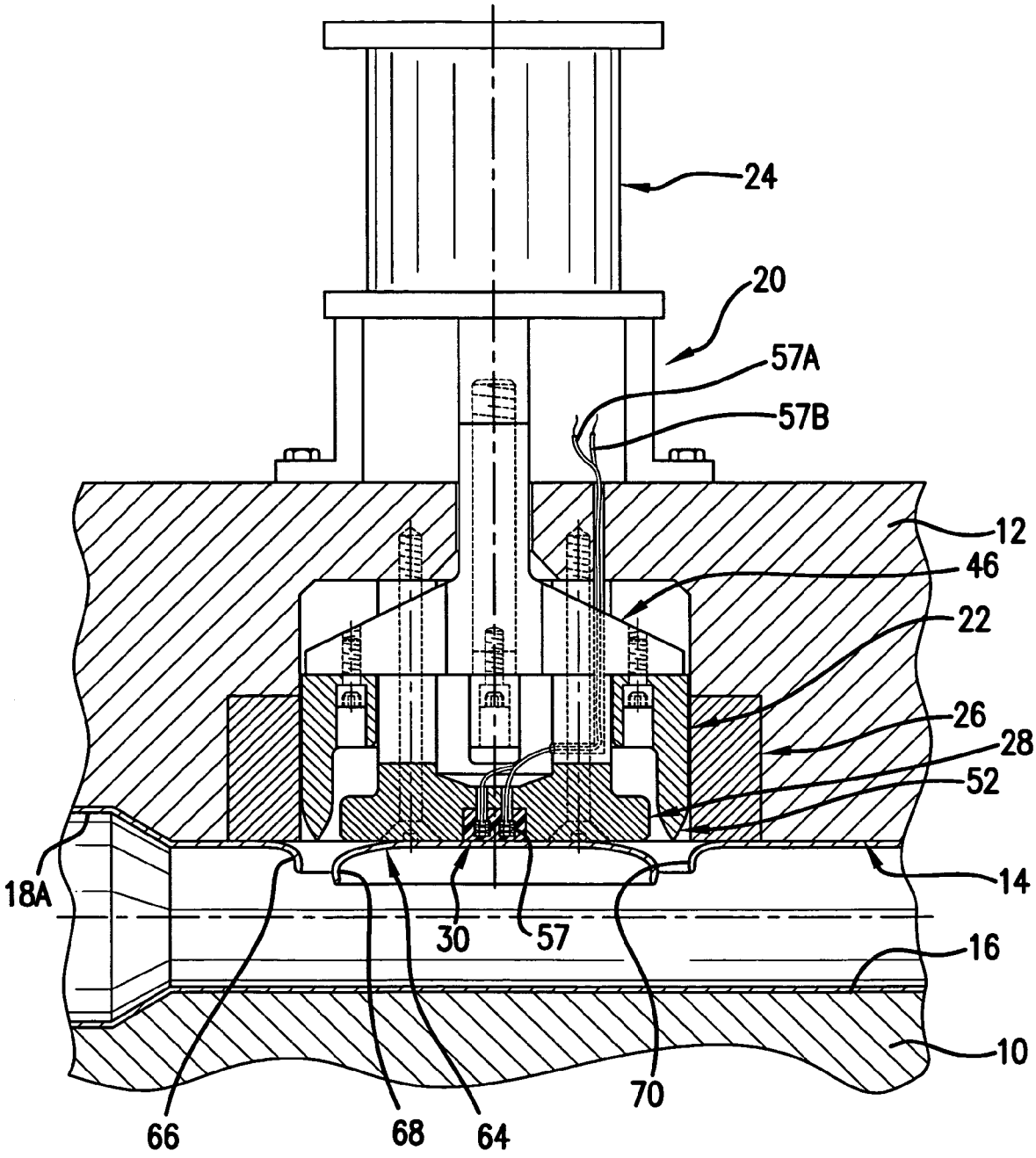
FIG. 7 is a view like FIG. 6 but showing the hydroforming fluid exhausted and the punch retracted with the slug still retained against the center support member.
Figure 8:
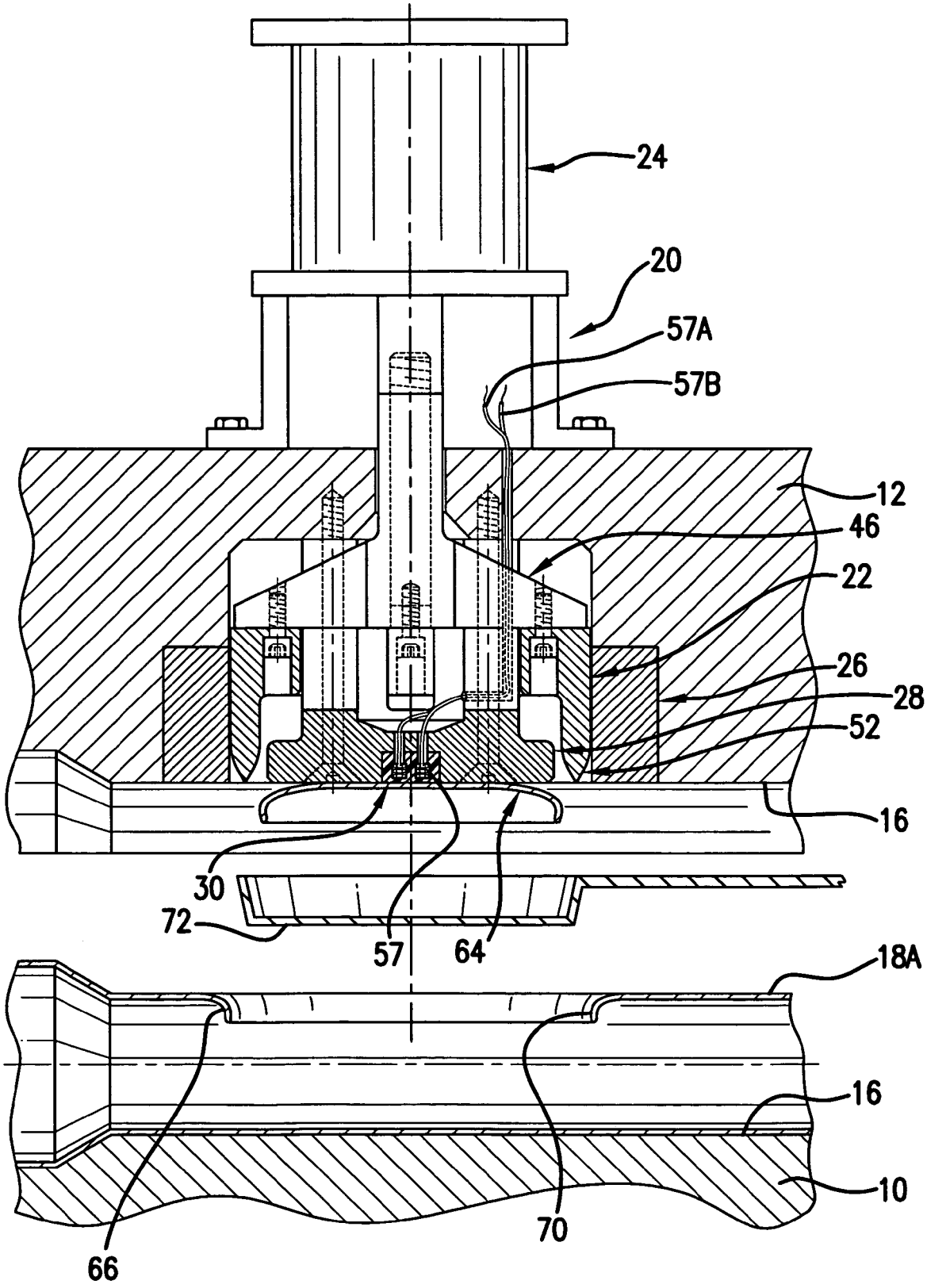
FIG. 8 is a view like FIG. 7 but showing the dies opened and a slug collection tray inserted between the upper die and the part in a position directly beneath the retained slug.
Figure 9:
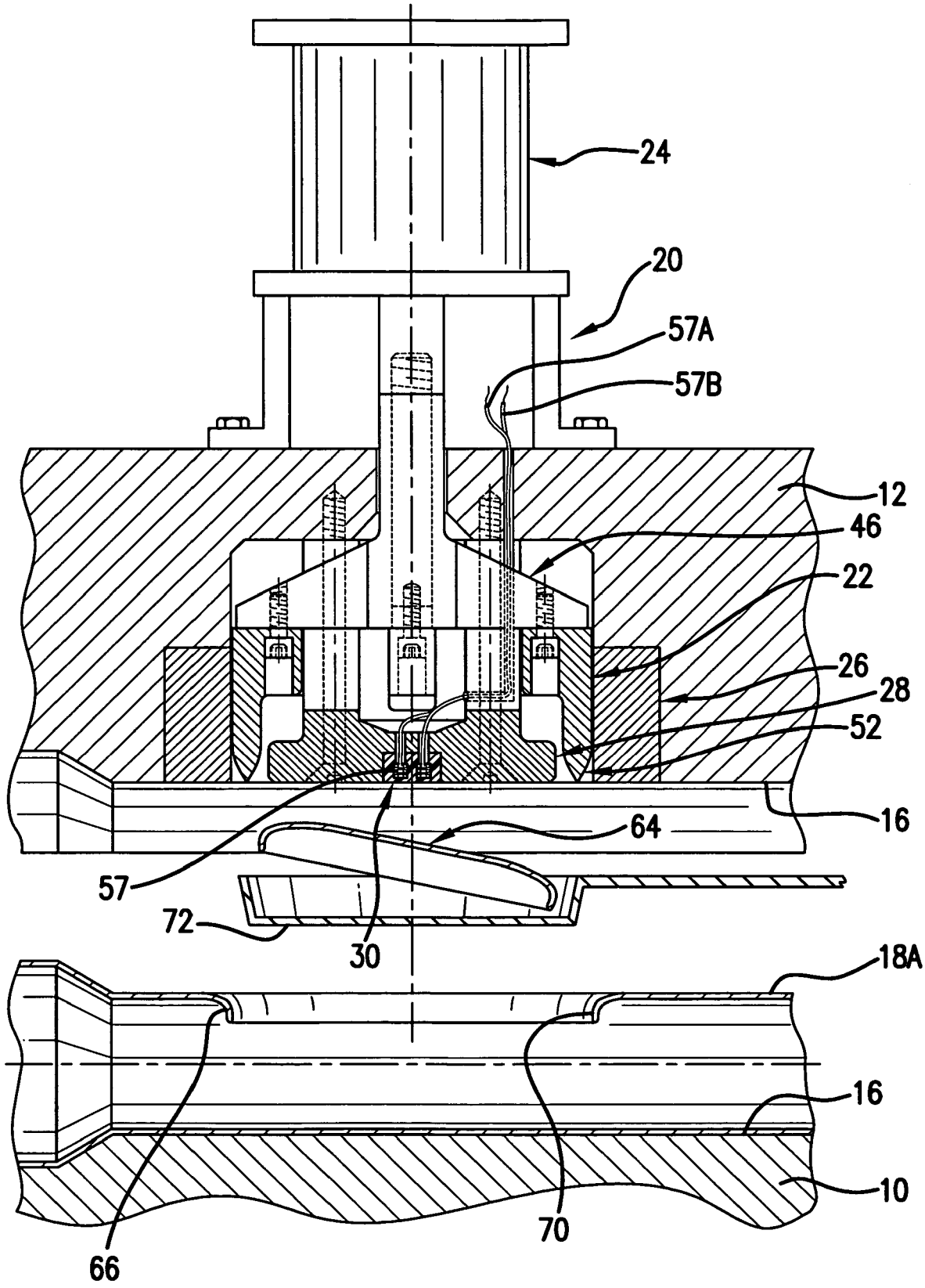
FIG. 9 is a view like FIG. 8 but showing the slug released to the collection tray.

Following the hole forming operation, the hydroforming fluid is exhausted from the part and the punch 22 is then retracted or returned by the hydraulic cylinder 24 to its initial position but now with the slug 64 retained inward thereof on the center support surface 62 by the slug retainer 30 as shown in FIG. 7. The upper die 12 is then raised to permit entry of a slug collection cup 72 as shown in FIG. 8 and finally the slug 64 is released by the slug retainer 30 and drops in to the collection cup as shown in FIG. 9 and removed from between the open dies prior to removal of the finished part from the lower die. With it being understood that the collection cup 72 can take various forms such as the long-handled cup shown and be operated by any suitable conventional means such a programmable robot.

The requirements of the hydraulic cylinder are even further reduced with the embodiment of the in-die hydropiercing device of the present invention shown in FIGS. 10-18. Wherein parts and features like those in FIGS. 2-9 are identified by the same two-digit numbers and letter suffixes but in a 100 numbering series and certain corresponding but structurally different features are identified also in a 100 numbering series but with different last two-digit numbers and the corresponding letter suffixes.

Figure 10:
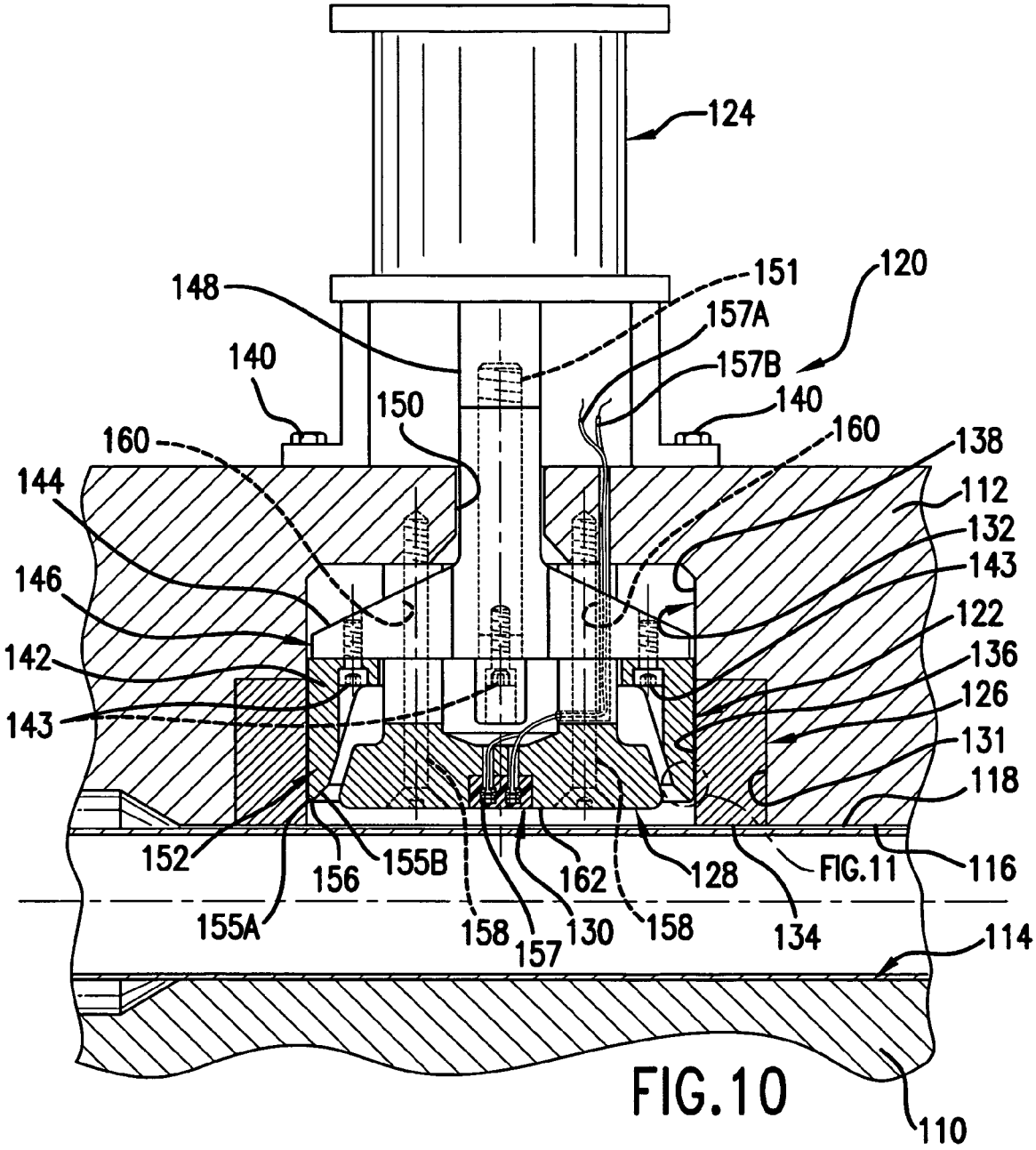
FIG. 10 is a view like FIG. 4 illustrating another embodiment of the in-die hydropiercing device according to the present invention wherein the punch is shown conditioned as before but the center support member is now fixed in a recessed position with respect to the surrounding die button.
Figure 11:
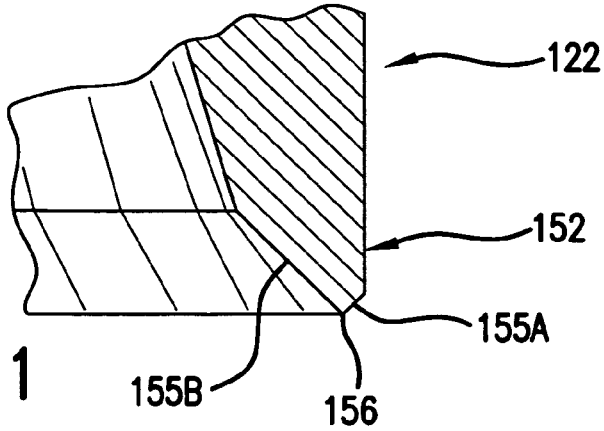
FIG. 11 is an enlarged view of the punch blade edge within the dash line circle in FIG. 10.

In the embodiment in FIGS. 10-18, the hydropiercing device 120 is essentially the same as that in FIGS. 2-9 but the center support member 128 is now fixed in the upper die 112 so that its face 162 is recessed a substantial distance from the surrounding die button face 134 and die cavity surface 116 as shown in FIG. 10. Which is a view like FIG. 4 showing when the dies 110 and 112 are closed on a piece of stock 118 and just prior to the hydroforming operation. In addition, the hydraulic cylinder 124 is operated to now position the punch 122 for the hydroforming operation so that the punch blade edge 156 is also recessed within the die button 126 and also, but to less extent, with respect to the center support surface 162. And the punch blade instead of having convex sides now has angled or straight tapered annular sides 155A and 155B that terminate at the shearing edge 156 and with the outer side 155A at the same angle but substantially shorter in length than the inner side 155B as best seen in FIG. 11. As this form of blade configuration has been found to also provide satisfactory results in the inward extrusion operation in providing for efficient sealing against leakage during the piercing operation as will now be described starting with the hydroforming operation shown in FIG. 12.

Figure 12:
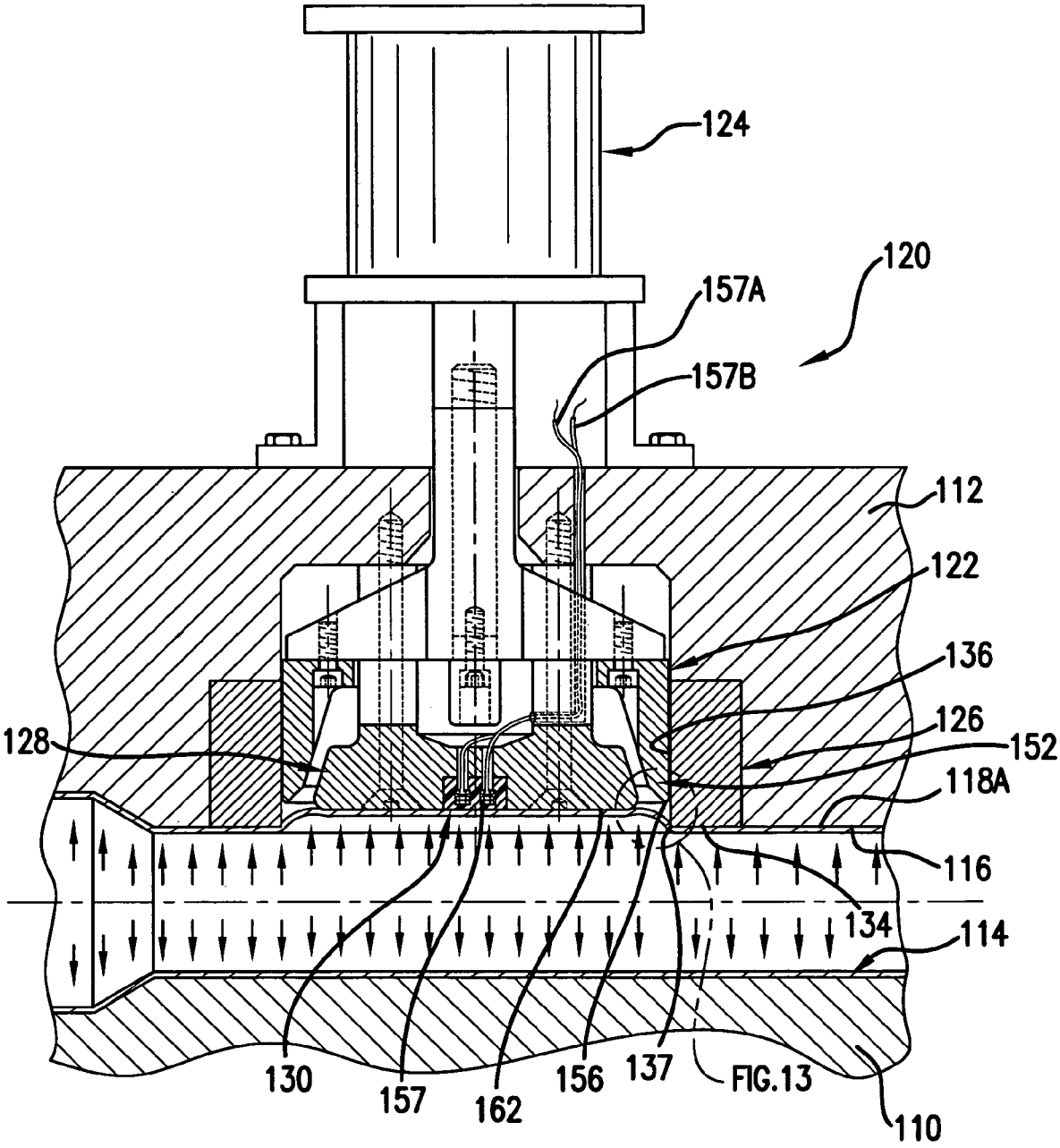
FIG. 12 is a view like FIG. 10 but showing hydroforming pressure forming the part.
Figure 13:
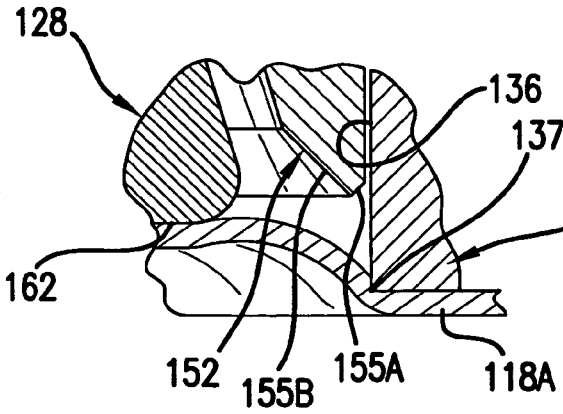
FIG. 13 is an enlarged view of the region within the dash line circle in FIG. 12.

As shown in FIG. 12, the hydroforming operation in the forming of the part 118A is now also utilized to stretch the wall of the part outward onto the recessed center support surface 162 and over the sharp outer edge 137 of the die bore 136. With the result that the annular section of the wall of the part at the die button edge 137 is weakened significantly by being reduced in wall thickness to the point of almost shearing or breaking as best seen in FIG. 13 and in what may be described as a prepiercing operation in preparation for the eventual actual piercing.

Figure 14:
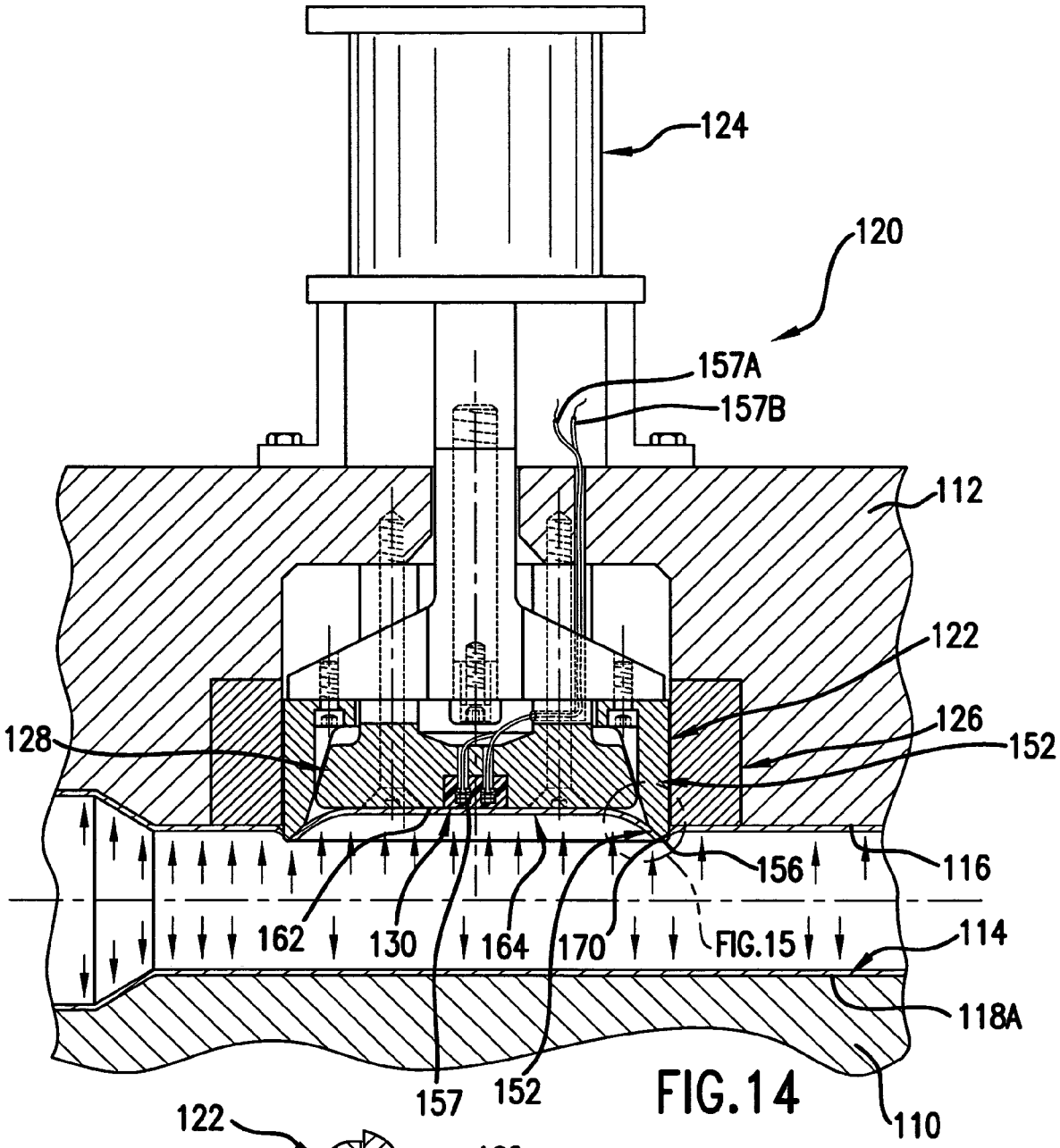
FIG. 14 is view like FIG. 12 but showing the punch piercing the part to form a hole and a resultant slug that is retained against the center support member.
Figure 15:
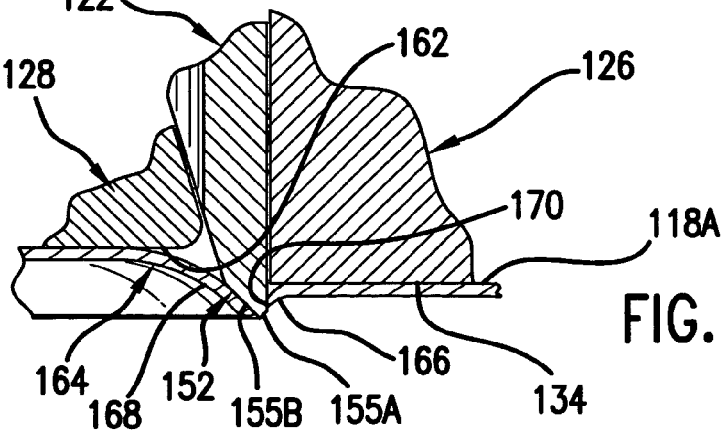
FIG. 15 is an enlarged view of the region within the dash line circle in FIG. 14.

At this stage and referring to FIGS. 14 and 15, the punch 122 is then plunged by the hydraulic cylinder 124 to pierce the part and form the required hole 170 while forming with the outer blade side 155A an inwardly extending collar 166 in the wall of the part that effectively seals against the outer cylindrical surface of the punch blade and is of substantially less depth than the collar 66 formed in the previous embodiment. At the same time, the inner blade side 155B forcibly sealingly engages while inwardly deflecting further the already outwardly deformed annular portion of the wall of the part inward of the shearing edge 156 and which forms the other sealing collar 168 to complete the prevention of leakage. And wherein it has been found that even with the lesser wall formation about the hole and only the inward deflection of the periphery of the slug as described above, leakage of the hydroforming fluid is still prevented and with substantially less hydraulic cylinder stroke and accompanying less hydraulic flow requirements as well as lower power requirements when compared with the hydropiercing device in FIGS. 2-9.

Figure 16:
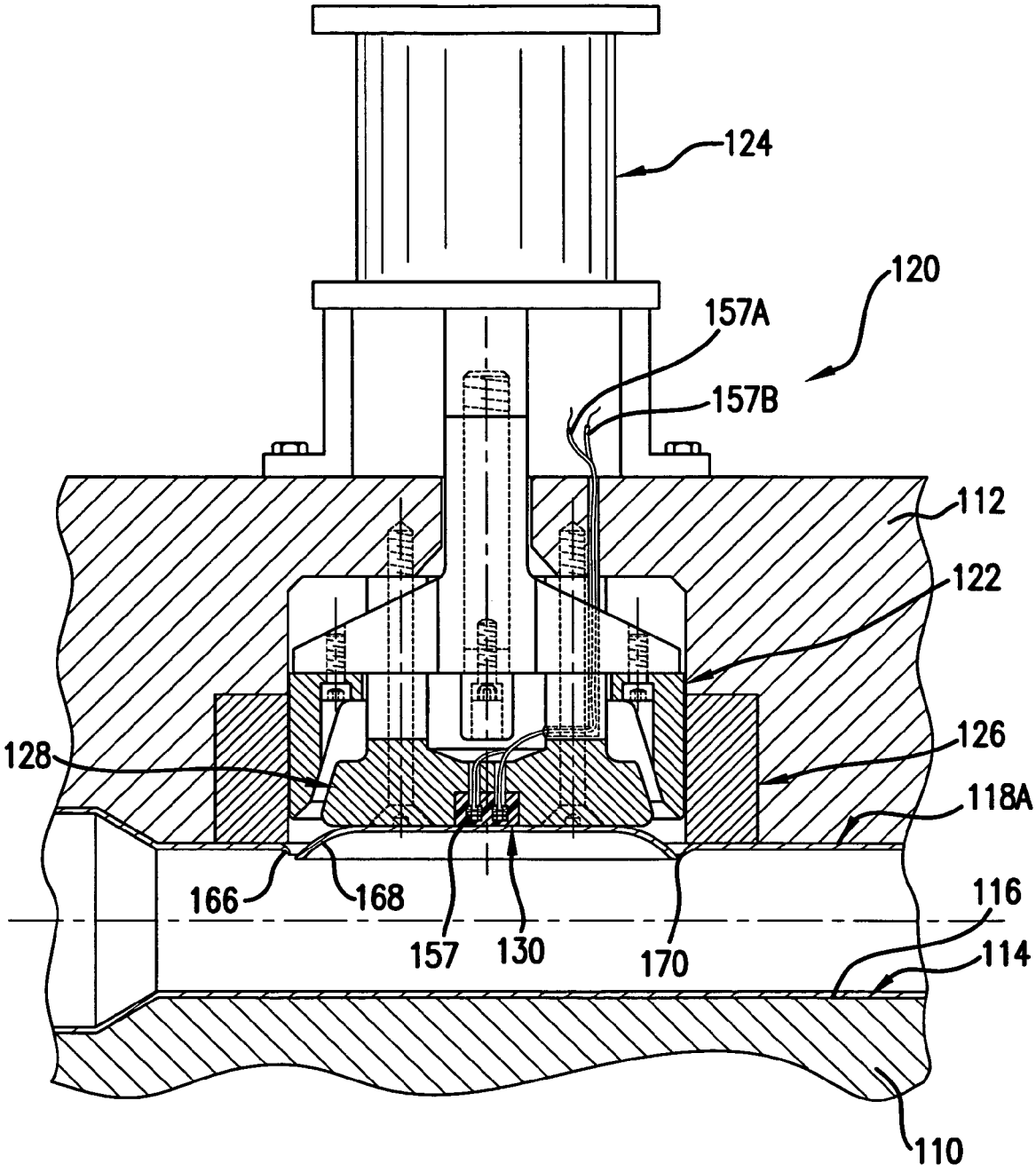
FIG. 16 is a view like FIG. 14 but showing the punch retracted with the slug still retained against the center support member.
Figure 17:
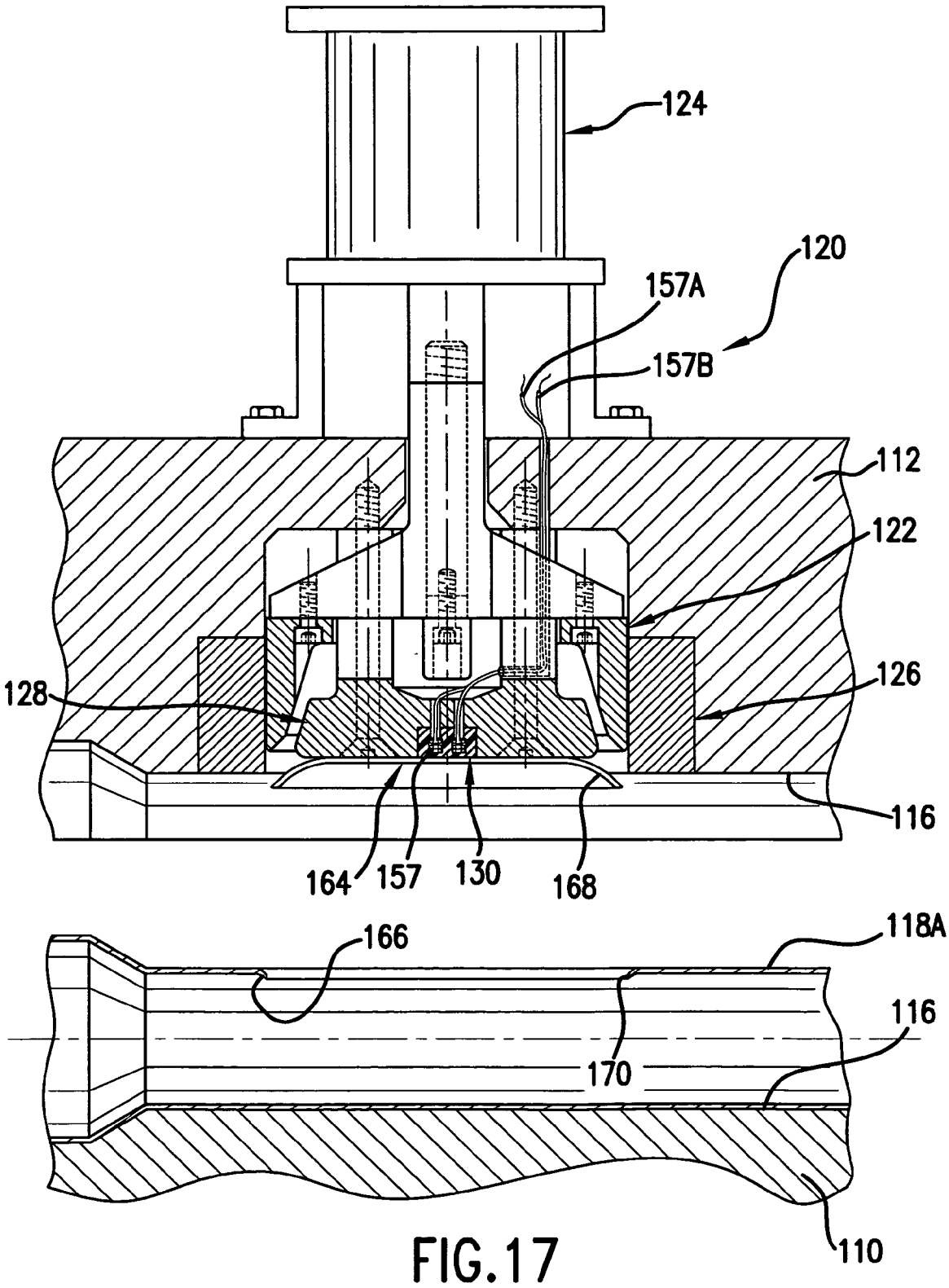
FIG. 17 is a view like FIG. 16 but showing the dies opened.
Figure 18:
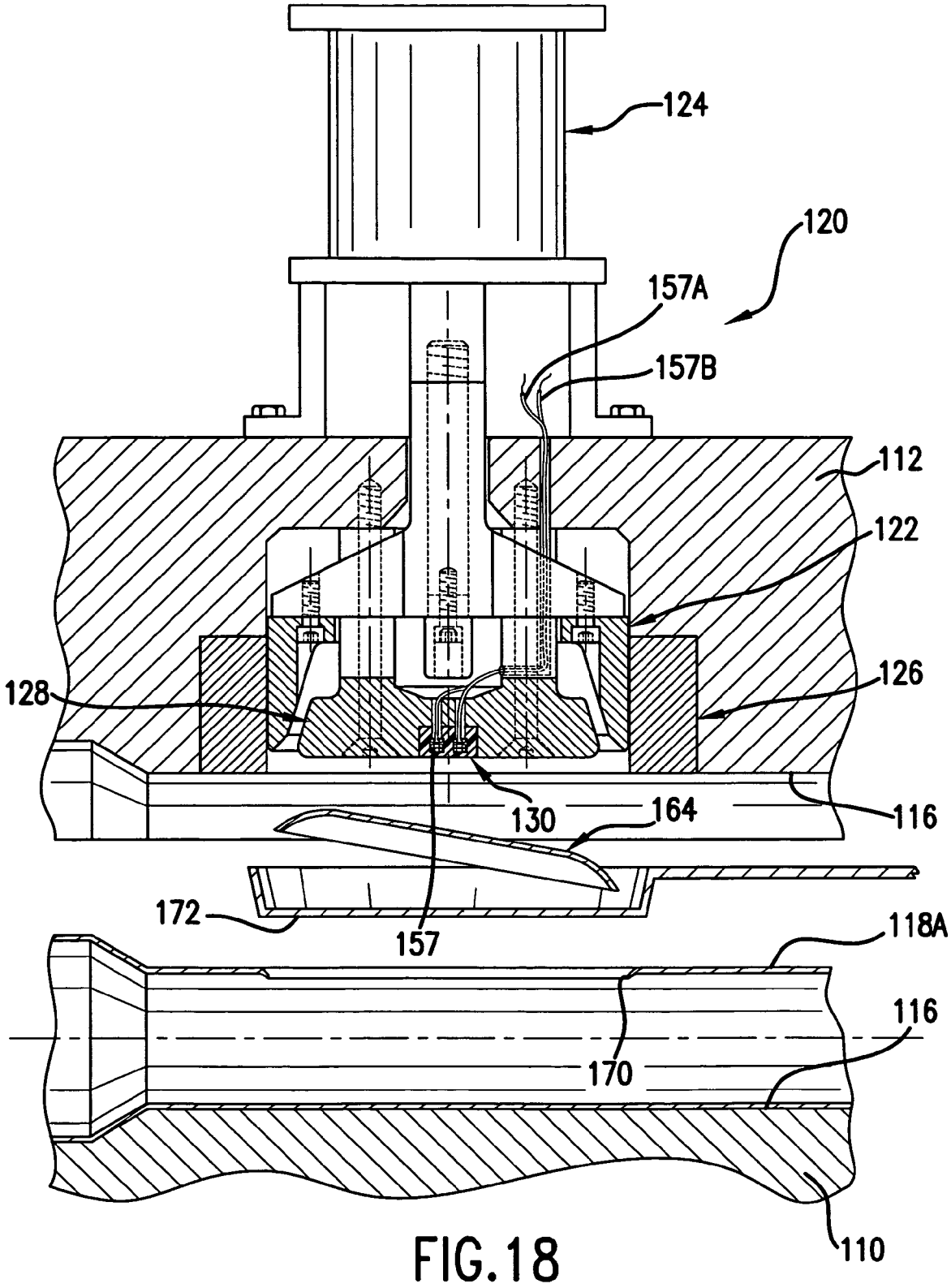
FIG. 18 is a view like FIG. 17 but showing the slug released to a collection tray.

Like in the previous embodiment, a slug 164 is produced in the formation of the hole 170 and is retained free of the hole against the center support member surface 162 by the forming pressure as well as the slug retainer 130 that is mounted in the center of the center support member surface. At this stage and like in the previous embodiment, the hydroforming fluid is exhausted from the part and the punch 122 is then retracted by the hydraulic cylinder 124 to its initial recessed position as shown in FIG. 16 and thereafter the die 112 is then raised as shown in FIG. 17 carrying the retained slug 164 with it. Where after the slug retainer 130 is then operated to release the slug 164 in to the slug collection cup 172 that is caused to enter between the open dies as shown in FIG. 18 and then leave with the collected slug for disposal where after the finished part is then removed from the lower die.

In the above-described exemplary embodiments of the invention, the in-die hydropiercing device has been disclosed in its adaptation to the formation of a circular hole. And it will be understood that the hole can be formed with the present device in either a flat or curved wall portion of the part wherein the curved portion may be either concave or convex. It will also be understood that the present device is readily adaptable to hydropiercing holes of various sizes as well as other shapes such as oval, square, rectangular and other required shapes. Simply by providing the punch body including the annular blade, the center bore of the die button and the periphery of the center support member with the shape and size required for a particular size and shape hole. It will also be understood that with leakage prevented and where more than one hole is required in a hydroformed part, a corresponding number of the present in-die hydropiercing devices could be used to punch all the required holes simultaneously and wherein such holes can be of the same size and shape or of different sizes as well as different shapes.

Furthermore, it is contemplated that various forms and modifications of the exemplary in-die hydropiercing devices shown and described are likely to occur from the disclosure thereof to those skilled in this art. And therefore, the present invention is intended to be limited only by the scope of the appended claims.

The invention claimed is:

1. An in-die hydropiercing device comprising a die button adapted to be mounted in one of two hydroforming dies that form a die cavity for the hydroforming of a part, a punch received in the die button having an annular blade with a shearing edge, a center support member received in the punch blade adapted to be fixed to the one die and to support the part within the center of the blade during the hydroforming of the part, a hydraulic cylinder adapted to operate the punch so as to hold the blade in a non-piercing position within the die button during the hydroforming of the part and to extend the blade past the die button and the center support member to pierce a hole in the hydroformed part with the shearing edge and with the support of hydroforming fluid under pressure in the hydroformed part and whereby a slug is pierced from the hydroformed part and pressed against the center support member by the hydroforming pressure, a slug retainer mounted on the center support member adapted to retain the slug against the center support member when the hydroforming pressure is exhausted and then release the slug upon opening of the dies, the punch blade also being adapted to effect sealing between the punch blade and both the hydroformed part and the slug during the formation of the hole to prevent leakage of the hydroforming fluid past the punch blade following the initial piercing of the hydroformed part, and a slug collector adapted to be inserted between the dies on opening of the dies and collect the slug from the center support member on release by the slug retainer device and then retract with the collected slug for slug disposal.

2. An in-die hydropiercing device as set forth in claim 1 wherein the punch blade has convex sides terminating at the shearing edge.

3. An in-die hydropiercing device as set forth in claim 1 wherein the punch blade has straight tapered sides terminating at the shearing edge.

4. An in-die hydropiercing device as set forth in claim 1 wherein the die button has an outer face flush with a surrounding surface of the die cavity in the one die, and the center support member has an outer face flush with the outer face of the die button.

5. An in-die hydropiercing device as set forth in claim 1 wherein the die button has a bore receiving the punch and an outer face flush with a surrounding surface of the die cavity in the one die, and the center support member has an outer face that is recessed with respect to the outer face of the die button to thereby allow an annular wall portion of the part to be stretched over an edge of the die button bore at the outer face of the die button and thereby be significantly weakened during the hydroforming of the part prior to piercing the annular wall portion by the punch blade.

6. An in-die hydropiercing device as set forth in claim 1 wherein the slug retainer is an electromagnet.

7. An in-die hydropiercing device as set forth in claim 1 wherein the slug retainer is a vacuum operated device.

8. An in-die hydropiercing device as set forth in claim 1 wherein the slug collector is a collection cup adapted to be inserted between the open dies to collect the slug and then be removed with the slug from between the open dies for disposal of the slug.

9. An in-die hydropiercing device as set forth in claim 1 wherein the shearing edge is smaller than that of the hole required, the punch has a main body from which the blade extends, the blade has an outer blade side adapted to inwardly extrude an annular wall portion of the part surrounding the hole in sealing contact with the outer blade side and an inner blade side adapted to inwardly extrude a peripheral portion of the slug in sealing contact with the inner blade side, and the main body of the punch has a periphery equal in size to the hole required.

10. An in-die hydropiercing device as set in claim 4 wherein the hydraulic cylinder is adapted to position the punch so that the shearing edge is flush with the outer face of the die button and the outer face of the center support member during the hydroforming of the part.

11. An in-die hydropiercing device as set forth in claim 5 wherein the hydraulic cylinder is adapted to position the punch so that the shearing edge is retracted with respect to the outer face of the die button during the hydroforming of the part.

* * * * *